United States Patent [19]

Luh

[11] 4,368,473

[45] Jan. 11, 1983

[54] MICROWAVE LENS RIPPLE FILTER

[75] Inventor: Howard H. Luh, Sunnyvale, Calif.

[73] Assignee: Ford Aerospace & Communications Corporation, Detroit, Mich.

[21] Appl. No.: 185,085

[22] Filed: Sep. 8, 1980

[51] Int. Cl.[3] ..... H01Q 15/02; H01Q 15/10

[52] U.S. Cl. ..... 343/753; 343/909

[58] Field of Search ..... 343/753, 754, 755, 909

[56] References Cited

U.S. PATENT DOCUMENTS

| | | | |
|---|---|---|---|
| 3,179,938 | 4/1965 | Howard et al. | 343/753 |
| 3,214,760 | 10/1965 | Yonkers | 343/753 |
| 3,392,393 | 7/1968 | Spitz | 343/754 |
| 3,698,001 | 10/1972 | Koyama et al. | 343/909 |
| 3,737,909 | 6/1973 | Bartlett et al. | 343/755 |
| 4,021,812 | 5/1977 | Schell et al. | 343/753 |
| 4,090,203 | 5/1978 | Duncan | 343/753 |
| 4,125,841 | 11/1978 | Munk | 343/909 |
| 4,126,866 | 11/1978 | Pelton | 343/909 |
| 4,169,268 | 9/1979 | Schell | 343/909 |

*Primary Examiner*—Eli Lieberman

*Attorney, Agent, or Firm*—Edward J. Radlo; Robert D. Sanborn

[57] ABSTRACT

An antenna system is disclosed comprising a lens and a feed array having several substantially identical feed elements. The antenna produces a coverage pattern of transmitted radiation in the form of a shaped beam. The present invention permits the use of a smaller number of feed elements for a given size of the lens' aperture by means of attenuating the sinusoidal ripple that is present in the shaped beam radiation pattern and caused by the size of the feed elements. A plurality of disks is placed in the focal plane of the lens. The disks are selective with respect to one spatial frequency of the emitted radiation (which is at a constant electromagnetic frequency). The disks may be fabricated of a material which reflects the radiation, a material which absorbs the radiation, or a dielectric material of a certain thickness stipulated herein which changes the phase of the radiation by 90°. By this technique, ripples are substantially removed from the beam pattern. The principles of the invention can be applied to antenna systems which are used to receive electromagnetic radiation.

8 Claims, 10 Drawing Figures

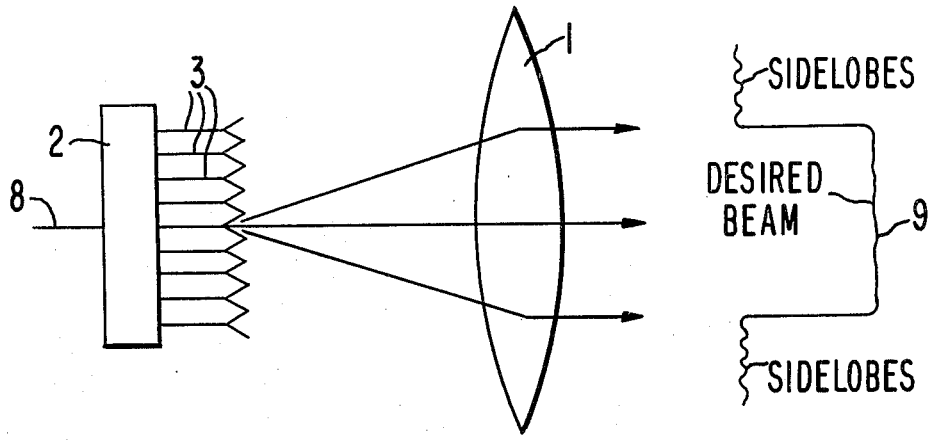
FIG.1A
FIG.1B
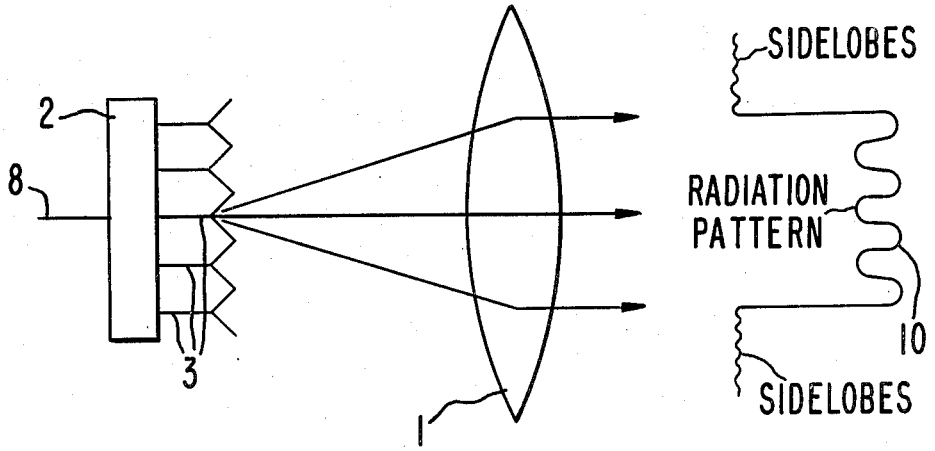

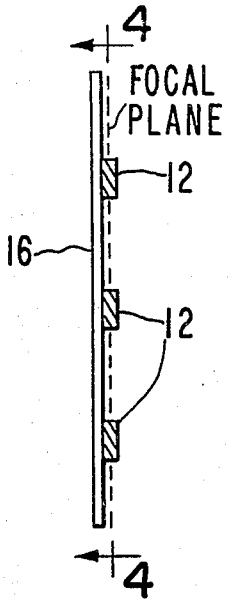
FIG.3A
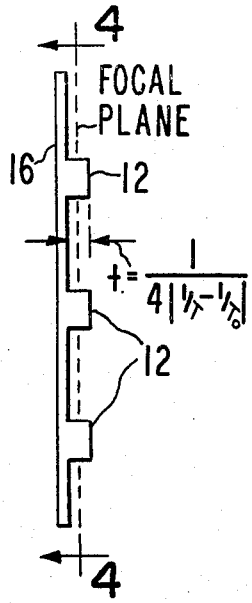
FIG.3B
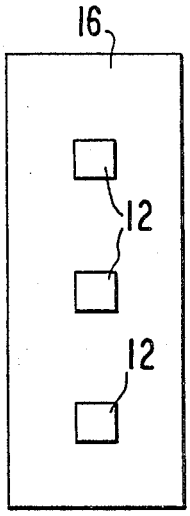
FIG.4A
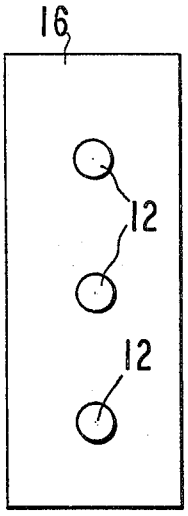
FIG.4B
FIG.5
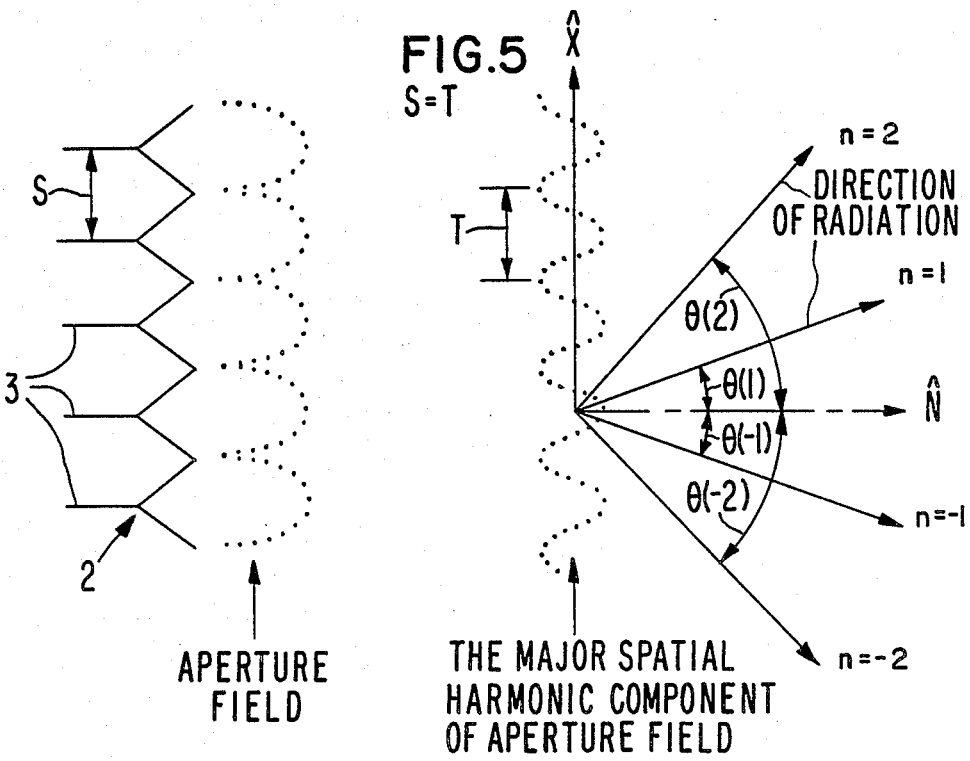

MICROWAVE LENS RIPPLE FILTER

BACKGROUND OF THE INVENTION

1. Field of the Invention

The invention is a device for smoothing out the ripple in the radiation pattern of a shaped beam antenna system employing a lens and a feed array having several feed elements. The invention has particular applicability to the transmission and reception of signals above 300 MHz, where the lens design is practical.

2. Description of the Prior Art

A prior art search was performed and uncovered the following U.S. patent references:

U.S. Pat. No. 3,737,909 is a technique for increasing the efficiency (gain) of a paraboloidal antenna system. The present invention, on the other hand, is directed to the smoothing of ripples within the pattern of a lens antenna system.

U.S. Pat. No. 4,090,203 is a system for selecting the power to be applied to each of a plurality of feed elements, and for selecting the spacing to be used between feed elements in a paraboloidal antenna system so as to attenuate sidelobes in such a system. The present invention is directed not to sidelobes but to the coverage area of a lens antenna.

U.S. Pat. No. 4,126,866 is a frequency sensitive surface which reflects all electromagnetic radiation at a designated frequency. The present invention, on the other hand, does not reflect all of the energy at a certain electromagnetic frequency, but rather reflects, absorbs, or changes the phase of only a certain *spatial* frequency component of the electromagnetic radiation.

U.S. Pat. No. 4,021,812 is directed to modifying the radiation pattern outside the coverage area of an antenna, whereas the present invention modifies the radiation pattern within the coverage area.

Other patents disclosed were U.S. Pat. Nos. 3,214,760, 3,392,393, 3,698,001, and 4,125,841.

SUMMARY OF THE INVENTION

The present invention is a technique for smoothing out the ripples within the coverage pattern of an antenna system comprising a plurality of substantially identical feed elements closely and contiguously spaced, and a focusing lens. A plurality of disks is inserted in the forward focal plane of the lens. These disks are sensitive to the major spatial frequency component of the Fourier transformed feed array aperture field amplitude.

In a first embodiment, the disks are fabricated of a material which reflects the electromagnetic radiation. In a second embodiment, the disks are made out of a substance which absorbs the radiation. In a third embodiment, the disks are fabricated of a dielectric material which shifts the phase of the radiation at said spatial frequency by 90°. In all cases, a single constant electromagnetic frequency is assumed.

For the first two embodiments, the thickness t of the disks is not critical; the cross-section of each disk in the plane orthogonal to the thickness dimension must be large enough to perform the desired attenuation, yet not so large as to attenuate the signal at locations other than corresponding to the desired spatial frequency. For the third embodiment, i.e., where the disks are fabricated of a dielectric material, the thickness t of each disk is selected to provide the desired 90° phase shift, and is given by the formula:

$$t=\tfrac{1}{4}\left|\lambda\lambda_0/(\lambda_0-\lambda)\right| \quad (1)$$

where $\lambda$ is the wavelength of the electromagnetic radiation in the dielectric, and $\lambda_0$ is the wavelength of the electromagnetic radiation in the free space surrounding the dielectric.

The disks are placed within the forward focal plane of the lens, i.e., that focal plane not containing the feed array. Spacing between disk centers is determined by an analysis described more fully hereinbelow.

BRIEF DESCRIPTION OF THE DRAWINGS

These and other more detailed and specific objects and features of the present invention are more fully disclosed in the following specification, reference being had to the accompanying drawings, in which:

FIG. 1(*a*) is a side view of an antenna system having a focusing lens and a plurality of feed elements, showing a representation of the resultant radiation pattern;

FIG. 1(*b*) shows the radiation pattern of the FIG. 1(*a*) system when the number of feed elements is reduced while keeping the aperture of the antenna constant;

FIG. 3(*a*) is a side view of the reflecting or absorbing disks of the present invention, showing their mechanical means of support;

FIG. 3(*b*) is a side view of the dielectric disk embodiment of the present invention, showing the mechanical means for supporting the disks;

FIG. 4(*a*) is a frontal view of the disks of the present invention, taken along lines 4—4 of either FIG. 3(*a*) or FIG. 3(*b*), showing disks with a square cross section;

FIG. 4(*b*) is a frontal view of the disks of the present invention, taken along lines 4—4 of either FIG. 3(*a*) or FIG. 3(*b*), showing disks with a circular cross section;

FIG. 5 illustrates the aperture field, the major spatial frequency component of the Fourier transformed aperture field, and major lines of propagation of said major spatial harmonic component;

DESCRIPTION OF THE PREFERRED EMBODIMENTS

Figure 2:
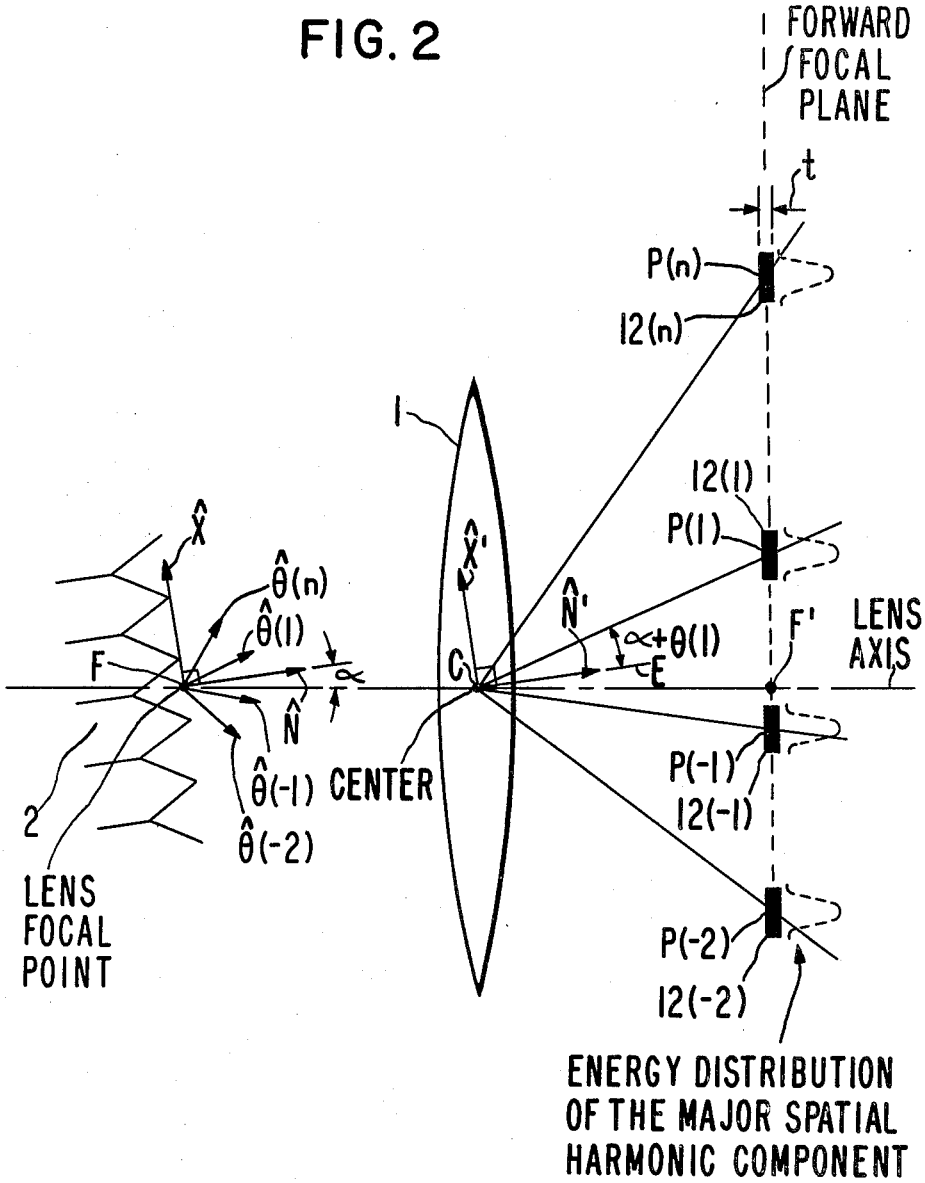
FIG. 2 is a side view of the lens antenna system, illustrating the disks of the present system in the focal plane of the lens.

This invention pertains to shaped beam area coverage antennas comprising a focusing lens 1, and a feed array 2 comprising a plurality of substantially identical and contiguous feed elements 3 (FIG. 1). The desired radiation pattern emanating from such a system is exemplified in curve 9. When the size of the antenna aperture increases, the overall size of feed array 2 must increase proportionately. The "aperture" of the antenna system is defined as the projection of the usable portion of lens 1 onto a plane which is orthogonal to the major geometric (and optical) axis of the lens. Each focal plane fits this definition. In addition, by definition, each focal plane passes through one of the two focal points of the lens (see FIG. 2). This invention works for non-symmetrical as well as symmetrical lenses, i.e., the two focal points do not have to be equidistant from the lens. This increase of aperture size results in a larger number of feed elements 3, if the quality of the output pattern is to remain constant. However, the use of a feed array 2 with too many feed elements is not practical because of the expense in tooling for the additional feed elements, and because the greater complexity causes tuning problems and RF loss in the excitation network.

If the total number of feed elements 3 is reduced by utilizing larger elements as is illustrated by FIG. 1(*b*) in comparison with FIG. 1(*a*), then objectionable ripples appear in the shaped beam radiation pattern 10 emanating from the lens. The representations 9 and 10 of the radiation patterns in FIG. 1 represent the amplitude of the radiated electromagnetic energy in a direction orthogonal to the forward focal plane of the lens. (The midpoint of feed array 2 lies in the rear focal plane of the lens.) Notice that the ripples have a substantially sinusoidal shape.

Although the radiation patterns of FIG. 1 represent the case where the antenna system is used to transmit radiation, the invention described herein has equal applicability when the antenna is used to receive radiation, and when the same antenna is used to transmit and receive radiation at the same frequency.

The ripples as illustrated in FIG. 1(*b*) are not acceptable in practice. The prior art offers no technique for reducing the ripples without reducing the size of the feed elements 3, which therefore, undesirably increases the total number of such feed elements.

The present invention remedies this problem by means of placing several disks 12 in that focal plane of lens 1 (the forward focal plane) situated on the side of the lens opposite feed array 2, as is illustrated in FIG. 2, which shows four disks, labeled 12(*n*), 12(1), 12(−1), and 12(−2). Each disk 12 is typically shaped so that it has one dimension which is smaller than the other two dimensions. This smallest dimension is designated thickness t and is oriented parallel to the lens axis and orthogonal to the forward focal plane.

The disks 12 may be fabricated of a dielectric material, i.e., a material which changes the velocity of propagation of the electromagnetic radiation. Plastic is one suitable material. The dielectric disks 12 should have a thickness t of:

$$t=\tfrac{1}{4}\,|\lambda\lambda_0/(\lambda_0-\lambda)| \qquad (1)$$

where $\lambda$ is the wavelength of the electromagnetic radiation in the dielectric and $\lambda_0$ is the wavelength of the electromagnetic radiation in the free space surrounding the disks 12. Throughout this specification, this radiation is assumed to occur at a single electromagnetic frequency. If it appears at a band of frequencies, the center frequency may be used an approximation.

Alternative to use of dielectric disks, the disks may be fabricated of a reflective conductive material such as a metal or a material such as carbon which absorbs the electromagnetic radiation. For these embodiments, unlike the dielectric embodiment, the thickness of the disks is not critical.

For all embodiments, the shape of the disks 12 in the plane orthogonal to thickness t is not critical. The disks can have a circular, square, or eliptical cross-section in this plane. Two of these cross-sections are illustrated in FIG. 4. FIG. 4(*a*) illustrates the embodiment where the disks 12 have a cross-section which is square and FIG. 4(*b*) illustrates the case where the disks 12 have a cross-section which is circular.

In the embodiment where the disks 12 are made of dielectric material, the function of the disks is to change the phase of the electromagnetic radiation by 90° at ripple peak locations so as to smooth out the ripple. In the embodiment where the disks are made of a reflective material, the function of the disks is to reflect the objectionable ripple peaks. In the embodiment where the disks are fabricated of an absorbing material, the function of the disks is to absorb the objectionable ripple peaks.

FIG. 3 shows means for mechanically holding the disks in place at the required spacing. In each case, the major means of support is a dielectric sheet 16. FIG. 3(*a*) represents the case where the disks 12 are reflective or absorbing, and FIG. 3(*b*) illustrates the case where the disks are dielectric. In each case, the dielectric sheet 16 is suspended parallel to and closely adjacent to the forward focal plane of lens 1 so that the disks 12 are bifurcated by the focal plane. The dielectric sheet 16 should be made as thin as possible so as to minimize its impact on the radiation pattern while being of sufficient thickness to give adequate mechanical support for the disks 12. The dielectric sheet 16 will have a minimal effect on the radiation pattern if it has a uniform thickness and is relatively thin. In FIG. 3(*a*), the disks are bonded or otherwise attached to sheet 16. Dielectric disks 12 may be fabricated in one piece in conjunction with sheet 16 as is illustrated in FIG. 3(*a*).

FIG. 5 illustrates how one establishes the spacing of the disks within the lens focal plane. This spacing is the same regardless of the material composition of the disks. The leftmost waveform on FIG. 5 is the aperture field of feed array 2, which is a waveform illustrating the amplitude of the transmitted electromagnetic radiation as a function of distance along the feed array. The rightmost waveform illustrates the major spatial harmonic frequency component of the aperture field, which is obtained when one takes the Fourier expansion of the aperture field curve. The period T of this harmonic component is identical to the spacing S between adjacent feed elements 3 within feed array 2. It is this major spatial harmonic which causes the undesired ripples in the radiation pattern of the antenna system. This spatial harmonic of period T radiates strongly in directions given by $$\theta(n)=\sin^{-1}[(2n-1)\lambda_0/T] \qquad (2)$$

for all integers n, where $\theta$ is the angle formed between the radiation and the axis $\hat{N}$;

$\hat{N}$ is a unit vector aligned along the feed array axis, i.e., the direction in which feed array 2 is pointing; and $\hat{X}$ is a unit vector aligned orthogonal to $\hat{N}$, i.e., $\hat{X}$ traverses the length of feed array 2 and is the coordinate defining the position of a particular feed element 3 along feed array 2.

In other words, the spatial harmonic radiates strongly in the directions given by the vectors;

$$\hat{\theta}(n)=\sin(\theta(n))\hat{X}+\cos(\theta(n))\hat{N} \qquad (3)$$

for all integers n.

Throughout most of the adjacent space, this energy is distributed. However, the energy is concentrated in the neighborhood of n discrete points P(n) on the forward focal plane of lens 1 as shown in FIG. 2. The location of the points can be determined as follows:

(i) Draw line CE through the center C of lens 1 such that the angle between CE and the lens axis is equal to $\alpha$, the angle between $\hat{N}$ and the lens axis. Let $\hat{N}'$ be the unit vector along line CE and $\hat{X}'$ be the unit vector orthogonal to $\hat{N}'$. F is the rear focal point of lens 1 and is also the midpoint of the active region of feed array 2. F' is the forward focal point of lens 1.

(ii) Draw the vectors $\hat{\theta}(n)$ (Eqn. 3) originating from point C by allowing $\hat{N}'$ to be used in lieu of $\hat{N}$ and by allowing $\hat{X}'$ to be used in lieu of $\hat{X}$.

(iii) The points P(n) are the intersections of each of the $\hat{\theta}(n)$'s (or linear extensions thereof) with the forward focal plane.

Disks 12 are placed at all points P(n) within the forward focal plane that fall within the aperture of lens 1. If one places reflecting disks 12 at these P(n) the energy of the offending spatial harmonic will be reflected by the disks. If one places absorbing disks 12 at these points, this energy will be absorbed by the disks. In either case, the energy will not radiate into the beam coverage areas and the ripples are removed from the radiation pattern. For reflecting and absorbing disks, thickness t is not critical, but the length L of each disk along the line formed by the intersection of the forward focal plane and the plane of FIG. 2 should be great enough to reflect or absorb the unwanted radiation, yet not so great as to interfere with the desired radiation.

If the disks 12 are fabricated of dielectric material, the disks will cause the energy at this particular spatial harmonic to undergo a phase change of 90°, assuming the disks have a thickness equal to $$t=\tfrac{1}{4}|\lambda\lambda_0/\lambda_0-\lambda| \tag{1}$$

The energy will not be reflected or absorbed in the case of dielectric disks. In the coverage area the wanted and unwanted harmonics will have a phase difference of +90° or −90° instead of 0° or 180° without the spatial filter. This will cause the amount of ripple (expressed as the ratio of the maximum and the minimum amplitude of the electromagnetic field in the coverage area) to be reduced from $$(W+U)/(W-U) \tag{4}$$

to $$\sqrt{\frac{W^2+U^2}{W}} \tag{5}$$

where W is the amplitude of the wanted spatial harmonic (fundamental harmonic) and U is the amplitude of the unwanted spatial harmonic.

Due to abberations in the lens system, the energy of the unwanted spatial harmonic may not be focused exactly at points P(n) in actual practice, but will be focused in the neighborhood of these points. Thus, for an optimum spatial filter, the location of the disks should be determined experimentally.

Figure 6:
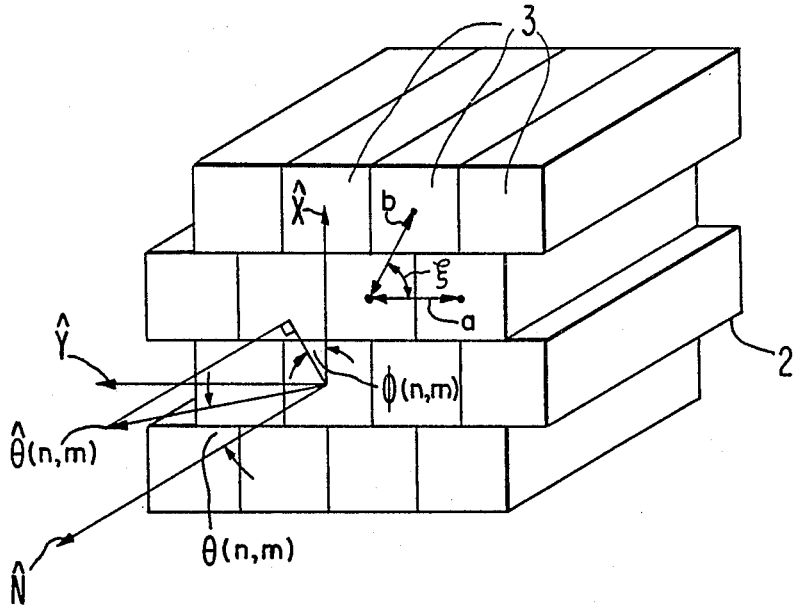
FIG. 6 is a three dimensional representation of a feed array that can be used in the present invention, wherein the active portions of the feed elements lie in a single plane.

In FIG. 2 it should be noted that the midpoints of all of the feed elements 3 lie in the plane of the drawing, and the disks 12 all have their midpoints placed in the plane of the drawing as well. Such is not the case where the feed array has more than one dimension. In that eventuality, some of the disks are out of the plane of FIG. 2 as described in detail hereinbelow:

FIG. 6 shows a three-dimensional feed array wherein the active portions of feed elements 3 lie in the same plane. In this sense, the feed array can be considered to be two-dimensional. For out purposes, the array can be completely characterized by the three parameters a, b, and $\xi$. a is the distance between the centers of adjacent elements 3 in the same row of elements. b is the distance between centers of adjacent elements 3 in the same column (in which the elements may be staggered, as depicted in FIG. 6). $\xi$ is the angle between the line connecting centers of elements within a row and the line connecting centers of two adjacent elements within the same column. If columnar staggering is not employed, $\xi$ is 90°.

The unwanted spatial harmonic radiates strongly in the directions given by the vectors:

$$\hat{\theta}(n,m)=\sin\theta(n,m)\cos\phi(n,m)\hat{X}+\sin\theta(n,m)\sin\phi(n,m)\hat{Y}+\cos\theta(n,m)\hat{N} \tag{6}$$

where n and m are any integers;

$\hat{N}$ is the unit vector aligned along the feed array axis;

$\hat{X}$ and $\hat{Y}$ are each unit vectors orthogonal to $\hat{N}$ and thus lie in the plane of the active region of array 2; and $\theta$(n,m) and $\phi$(n,m) satisfy the following two equations:

$$\sin\theta(n,m)\cos\phi(n,m)=\frac{(2n-1)\lambda_0}{a} \text{ and} \tag{7}$$

$$\sin\theta(n,m)\sin\phi(n,m)=\frac{(2m-1)\lambda_0}{b\cdot\sin\xi}-\frac{(2n-1)\lambda_0}{a\cdot\tan\xi} \tag{8}$$

Figure 7:
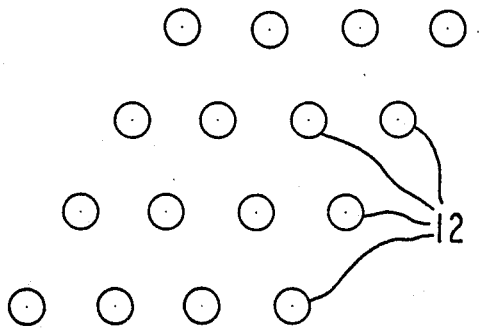
FIG. 7 is a representation of the forward focal plane showing the placement of disks therein when the feed array of FIG. 6 is used in the present invention.

The procedure for determining the location of filter disks 12 within the forward focal plane is the same as for the embodiment described previously where the active region of array 2 is one-dimensional, except that the $\hat{\theta}$(n,m)'s of Eqn. 6 are used instead of the $\hat{\theta}$(n)'s of Eqn. 3. FIG. 7 illustrates a typical pattern of disks 12 within the forward focal plane. As with the one-dimensional embodiment, exact placement should be verified operationally.

The above description is included to illustrate the operation of the preferred embodiments, and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. An antenna system comprising:

a lens capable of focusing electromagnetic radiation;

a feed array generally situated at a first focal plane of said lens and having a plurality of substantially identical radiation-directing feed elements pointed at said lens; and a spatial filter situated in a second focal plane of said lens for reducing the size of sinusoidal perturbations in the main beam region of the radiation pattern associated with said system.

2. An antenna system as recited in claim 1 wherein said spatial filter comprises a plurality of radiation absorbing elements placed within said second focal plane.

3. The antenna system as recited in claim 1 wherein said spatial filter comprises a plurality of radiation reflecting conductive elements placed within said second focal plane.

4. The antenna system as recited in claim 1 wherein said second spatial filter comprises a plurality of dielectric disks placed within said focal plane.

5. An antenna system as recited in claim 4 wherein the thickness of each of said dielectric disks is substantially equal to $$\tfrac{1}{4}|\lambda\lambda_0/(\lambda_0-\lambda)|$$

where $\lambda$ is the frequency of said radiation within the dielectric disks; and $\lambda_0$ is the frequency of said radiation in the space surrounding said disks.

6. The apparatus of claim 1 wherein said filter comprises n elements situated in said second focal plane and spaced apart from each other, where n is large enough to substantially cover the aperture of said lens;

wherein the angles $\theta(j)$ between a line drawn through the center of said lens and a line drawn between said center and the midpoint of each jth element, respectively, are given by:

$$\theta(j) = \sin^{-1}\frac{(2j-1)\lambda_0}{T} + \alpha$$

where $\lambda_0$ is the wavelength of said radiation in the space surrounding said system;

T is the spacing between each pair of adjacent feed elements; and $\alpha$ is the angle formed by the axis of said lens and the axis of said feed array.

7. The apparatus of claim 1 wherein said antenna system transmits and receives electromagnetic radiation at a predetermined electromagnetic frequency.

8. The apparatus of claim 1 wherein said feed array has at least two rows of feed elements, with the active portions of said feed elements all lying in the same plane.

* * * * *